US005797498A

United States Patent [19]

Kobayashi et al.

[11] Patent Number: 5,797,498

[45] Date of Patent: Aug. 25, 1998

[54] MAGNETIC SEPARATOR AND SWEEPING BRUSH USED THEREIN

[75] Inventors: Hisamine Kobayashi; Katsuhiro Izuhara, both of Nagoya, Japan

[73] Assignee: Tipton Corp., Nagoya, Japan

[21] Appl. No.: 564,728

[22] Filed: Nov. 29, 1995

[30] Foreign Application Priority Data

Nov. 30, 1994 [JP] Japan ..... 6-323690

[51] Int. Cl.[6] ..... B07C 5/344

[52] U.S. Cl. ..... 209/636; 209/221; 209/225; 209/229; 209/230; 209/231

[58] Field of Search ..... 209/636, 213, 209/215, 221, 225, 228, 229, 230, 231, 920

[56] References Cited

U.S. PATENT DOCUMENTS 294,021 2/1884 Faber ..... 209/229 X

FOREIGN PATENT DOCUMENTS 46-11022 4/1971 Japan .
62-23458 1/1987 Japan .
1-41482 12/1989 Japan .
2-36599 10/1990 Japan .

*Primary Examiner*—David H. Bollinger
*Attorney, Agent, or Firm*—Wenderoth, Lind, Ponack, L.L.P.

[57] ABSTRACT

A magnetic separator for separating a magnetic substance such as metal parts or workpieces from a nonmagnetic substance such as abrasives used in a barrel finishing includes an infeed passage along which a mixture of the workpieces and the abrasives is conveyed. A rotary drum is rotated in a direction crossing the infeed passage, and a magnet is mounted in the rotary drum so that the magnetic substance is attracted to a circumferential surface of the rotary drum. The workpieces picked up onto the rotary drum are conveyed along an outfeed package, and a demagnetizer establishes an alternating field in the middle of the outfeed passage along a direction in which the magnetic substance is conveyed along the outfeed passage. A sweeping brush is located on the infeed passage in the vicinity of the rotary drum so as to scrape the surface of the workpieces attracted to the surface of the rotary drum to sweep off granular abrasives adherent to the surface of the workpieces. A removing brush is located at the outfeed passage for scraping out the workpieces to dissociate them from the rotary drum.

12 Claims, 8 Drawing Sheets

MAGNETIC SEPARATOR AND SWEEPING BRUSH USED THEREIN

BACKGROUND OF THE INVENTION

1. Field of the Invention

This invention relates to a magnetic separator for separating a magnetic substance such as metal parts or workpieces from a nonmagnetic substance such as abrasives used in barrel finishing and a sweeping brush used in such a separator.

2. Description of the Prior Art

Magnetic separators are used in a process subsequent to barrel finishing, for example. In this process, the magnetic separator is used to separate metal workpieces (a magnetic substance) finished by abrasives and the like in a barrel finishing machine from the abrasives.

FIG. 11 illustrates one conventional magnetic separator. A mixture of workpieces and abrasives taken out of a barrel finishing machine is vibratingly conveyed along a feeder 1 provided with vibration exciters in the right-hand direction as viewed in FIG. 11. A rotary drum 2 having permanent magnets therein is mounted over the downstream side of the feeder 1 for rotation in a direction opposite to the direction in which the mixture is conveyed along the feeder 1, that is, in the counterclockwise direction. The rotary drum 2 attracts the workpieces in the mixture to thereby separate them. A conveying belt 5 extends between the rotary drum 2 and a guide roller 4 mounted on the right-hand end of a frame 3 so that the workpieces attracted to the rotary drum 2 can be conveyed along the conveying belt 5 in the right-hand direction. A demagnetizer 6 is provided inside the conveying belt 5 for producing an alternating field over the conveying belt 5 to demagnetize the workpieces magnetized as the result of attraction to the drum 2 when the workpieces are caused to pass through the alternating field.

The rotary drum 2 has twenty-four magnets 7 disposed along the outer circumference as shown in FIG. 12. The magnets 7 are circumferentially arranged in three rows, each of which includes eight magnets. Each magnet of the central row has a north pole and each magnet of the other rows has a south pole. Accordingly, lines of magnetic force from the rotary drum 2 are established in a direction crossing the direction of rotation of the drum, that is, in the direction of the rotational shaft.

The demagnetizer 6 has therein electromagnets 8 which are arranged at predetermined intervals in a row in a direction crossing the direction in which the workpieces are conveyed or the direction of arrow a, as shown in FIG. 13. Windings of adjacent electromagnets 8 are wound in opposite directions. An electric circuit or an alternating current source is provided for periodically changing the direction of current flowing through each electromagnet 8. Thus, the lines of magnetic force are established in a direction crossing the direction of rotation of the drum, that is, in the direction vertically penetrating the workpiece, and the direction of the lines is periodically changed. Consequently, an alternating field is established over the conveying belt 5 so that the magnetized workpieces are demagnetized.

A magnet has a characteristic of attracting metals along the lines of magnetic force. Accordingly, when the workpiece is attracted to the rotary drum, the axis of the workpiece tends to be parallel with that of the rotary drum. Accordingly, particularly when a bar-shaped workpiece such as an elongated bolt is picked up onto the conveying belt, the workpiece slips down the belt, rolling thereon, whereupon the workpiece remains below the rotary drum.

Furthermore, even where a workpiece which is apt to roll on the conveying belt due to its shape is conveyed to the upper side of the rotary drum without remaining below the drum, the workpiece cannot escape the attractive force from the rotary drum when departing from the conveying belt. Consequently, the workpiece is caused to slip, remaining at a boundary of the rotary drum.

On the other hand, workpieces with granular abrasives being carried thereon are sometimes conveyed along the feeder. In this case, the workpiece is either attracted to the rotary drum with the abrasives sandwiched therebetween or it cannot be attracted. For the foregoing reasons, the separating efficiency cannot be improved in conventional magnetic separators.

Additionally, the conventional demagnetizer is provided with only a single row of electromagnets. Moreover, the lines of magnetic force are established in the direction crossing the direction in which the workpieces are conveyed. The magnetic field intensity is not uniform, that is, the magnetic field intensity is reduced as the magnetic field departs further from the electromagnet, and the magnetic field is particularly weak in the center thereof. Consequently, since demagnetization of the workpieces is rendered nonuniform depending upon the positions of the workpieces relative to the magnetic field, the amount of residual magnetism in the workpiece is increased.

SUMMARY OF THE INVENTION

Therefore, objects of the present invention are to provide a magnetic separator wherein the separating efficiency can be improved and wherein the demagnetizing efficiency can be improved so that the amount of residual magnetism in the workpiece can be reduced, and to provide a sweeping brush used in the magnetic separator.

The present invention provides a magnetic separator comprising an infeed passage along which a mixture of a magnetic substance and a nonmagnetic substance is conveyed. A rotary drum is provided for rotation in a direction crossing the infeed passage. Magnets are provided in the rotary drum so that the magnetic substance is attracted to a circumferential surface of the rotary drum. An attitude correcting means corrects the attitude of the magnetic substance being conveyed along the infeed passage so that the magnetic substance is directed circumferentially of the rotary drum.

Lines of magnetic force from the rotary drum are established along the circumference thereof. Accordingly, the magnetic substance conveyed along the infeed passage with the nonmagnetic substance is attracted to the rotary drum in a condition in which the substance is directed along the direction of rotation of the rotary drum. Consequently, the magnetic substance, even if it is bar-shaped, can be prevented from slipping down the outer circumferential face of the rotary drum and remaining below the drum. Thus, since the magnetic substance can be reliably separated from the nonmagnetic substance to be conveyed, the separating efficiency can be improved.

The attitude correcting means preferably comprises two types of magnets arranged circumferentially of the rotary drum in a section crossing an axis of the rotary drum. One type includes a plurality of magnets each having a north pole at a side opposite to a circumferential surface of the rotary drum. The other type includes a plurality of magnets disposed between the magnets of the north pole of the one type and each having a south pole at a side opposite to the circumferential surface of the rotary drum.

The magnetic separator may further comprise a sweeping member provided on the infeed passage in the vicinity of the rotary drum so as to scrape the surface of the magnetic substance attracted to the surface of the rotary drum, thereby sweeping off extraneous matter adherent to the surface of the magnetic substance. Preferably, the sweeping member includes a magnetized free rotating shaft which is parallel with the axis of the rotary drum and which is rotated with the rotary drum when the latter is rotated and a bristle portion radially projecting from the free rotating shaft for sweeping off the extraneous matter adherent to the surface of the magnetic substance. Preferably, the bristle portion is spirally disposed along the axis of the free rotating shaft.

Even when extraneous matter such as the nonmagnetic substance to be eliminated adheres to the magnetic substance, the extraneous matter is swept off by the sweeping member. Consequently, since the separated magnetic substance can be prevented from including the nonmagnetic substance, the separating efficiency can be improved. Furthermore, since entangled magnetic substances are removed from one another, the nonmagnetic substance can be prevented from being sandwiched between the entangled magnetic substances. Furthermore, a spiral groove is defined along the spiral bristle portion. Even when the magnetic substance is smaller than the spiral groove, a spiral edge of the bristle portion is reliably brought into contact with the magnetic substance during one turn of the shaft. The manufacturing cost of the sweeping member can be reduced as compared with the case where no spiral groove is defined. Moreover, the magnetic substance can be effectively prevented from remaining below the rotary drum even when the magnetic substance is smaller than the spiral groove.

The present invention also provides a magnetic separator comprising an infeed passage along which a mixture of a magnetic substance and a nonmagnetic substance is conveyed, a rotary drum provided for rotation in a direction crossing the infeed passage, magnets provided in the rotary drum so that the magnetic substance is attracted to a circumferential surface of the rotary drum, an outfeed passage along which the magnetic substance picked up onto the rotary drum is conveyed so that the magnetic substance is taken out, and a plurality of magnets disposed in a zigzag arrangement in the middle of the outfeed passage for establishing an alternating field crossing the direction in which the magnetic substance is conveyed on the outfeed passage.

The lines of magnetic force from the magnets are established crossing the direction in which the magnetic substance is conveyed on the outfeed passage. The alternating field is uniform irrespective of the position of the magnetic substance passing therethrough. Consequently, the magnetic substance can be uniformly demagnetized. Furthermore, since the magnets are disposed in a zigzag arrangement, the magnetic substance can be reliably demagnetized.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

A magnetic separator of a first embodiment in accordance with the present invention will be described with reference to FIGS. 1 to 7 together with a sweeping brush employed therein. The magnetic separator of the first embodiment is used in a process subsequent to barrel finishing. In this process, the magnetic separator is used to separate metal workpieces (a magnetic substance) finished by abrasives (a nonmagnetic substance) and the like in a barrel finishing machine from a mixture of the former and the latter. The magnetic separator comprises a vibratory conveyor 11, a pickup conveying mechanism 22, and a demagnetizer 33.

Figure 1:
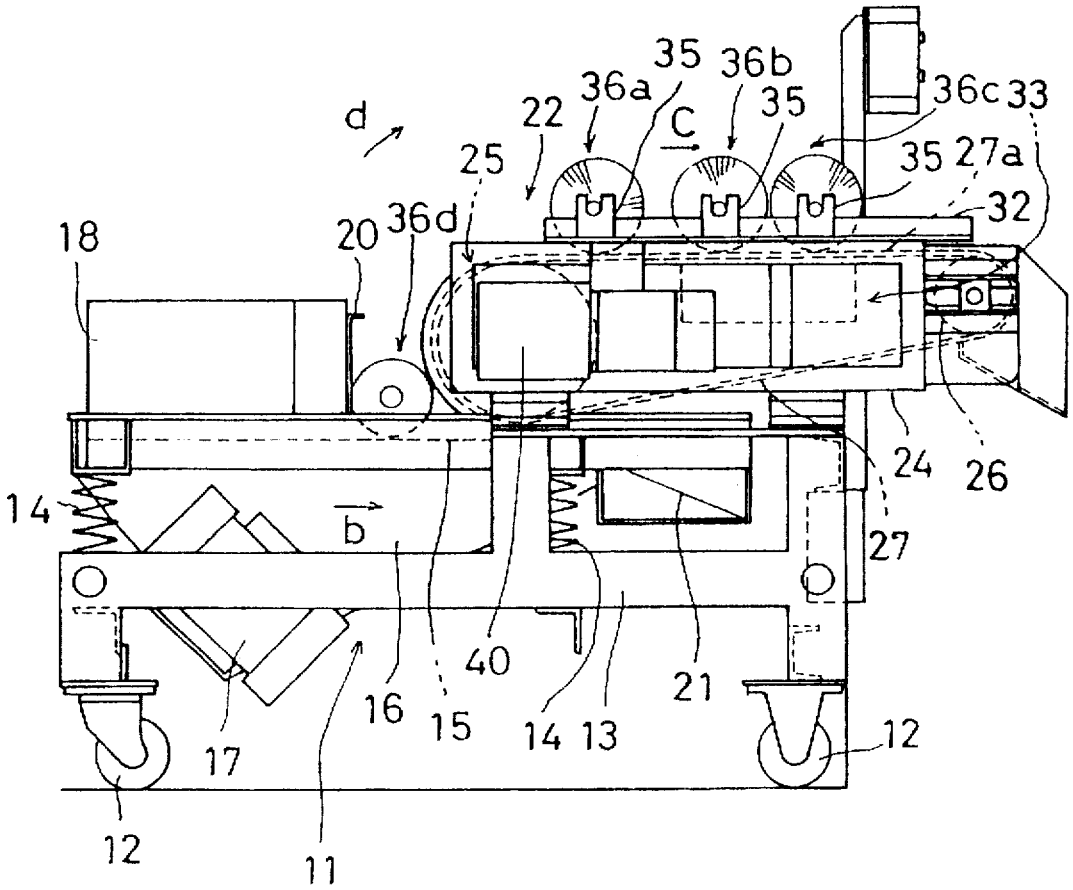
FIG. 1 is a front view of a magnetic separator of a first embodiment in accordance with the present invention.
Figure 2:
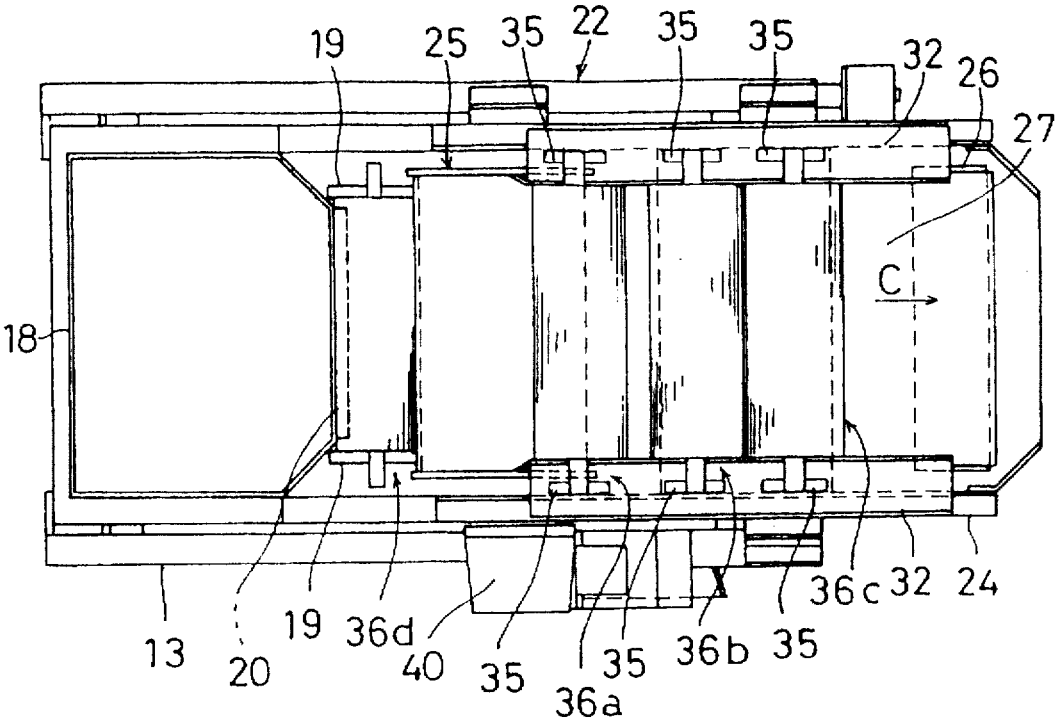
FIG. 2 is a top view of the magnetic separator.
Figure 3:
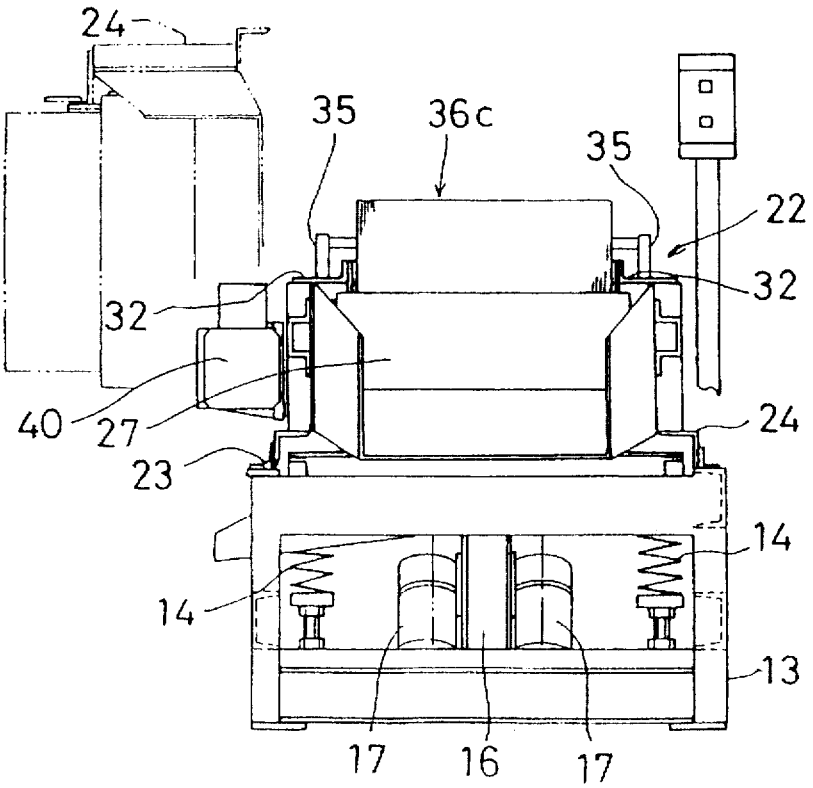
FIG. 3 is a side view of the magnetic separator.

Referring to FIG. 1, the vibratory conveyor 11 is suspended on a frame 13 having wheels 12 with coil springs 14 being interposed therebetween. The vibratory conveyor 11 includes a feeder 15 (an infeed passage) feeding the mixture of the workpieces and the abrasives by means of vibration. A pair of vibration exciters 17 are mounted on a mounting plate 16 which is further mounted on the underside of the feeder 15. A hopper 18 is mounted on the left-hand upper portion of the feeder 15 for introducing the mixture discharged from a barrel finishing machine (not shown) over the feeder. The hopper 18 has an outlet from which a pair of guide plates 19 extends to prevent the mixture from falling out of both sides of the feeder 15 as shown in FIG. 2. An adjusting plate 20 is vertically attached to the outlet of the hopper 18 for increasing or decreasing a space between the lower end thereof and the feeder 15 to thereby adjust the amount of mixture supplied onto the feeder 15. A discharge passage 21 extends from the termination of the feeder 15 and is bent to the right with respect to the direction of extension thereof, terminating at an open end, as shown in FIG. 1. The abrasives are discharged from the open end of the passage 21 after separation of the workpieces from the mixture by the pickup conveying mechanism 22.

Figure 4:
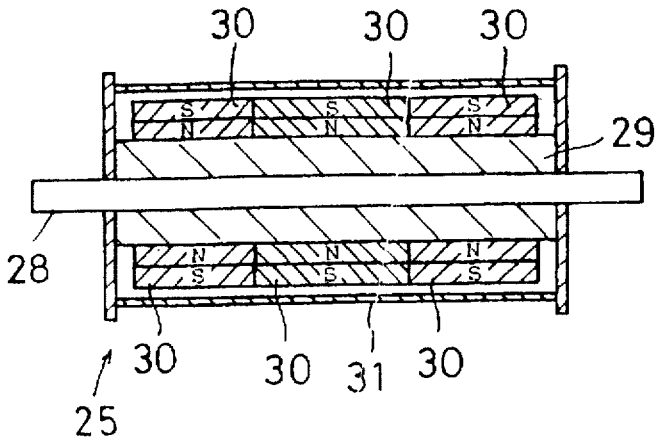
FIG. 4 is a sectional view taken along line IV—IV in FIG. 5.
Figure 5:
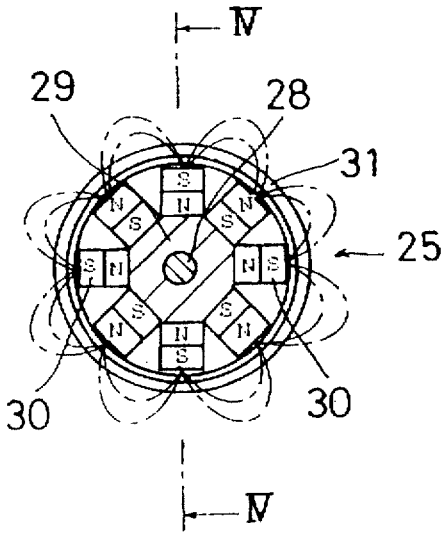
FIG. 5 is a sectional view taken in a direction crossing a rotational shaft of a rotary drum constituting the magnetic separator.
Figure 6:
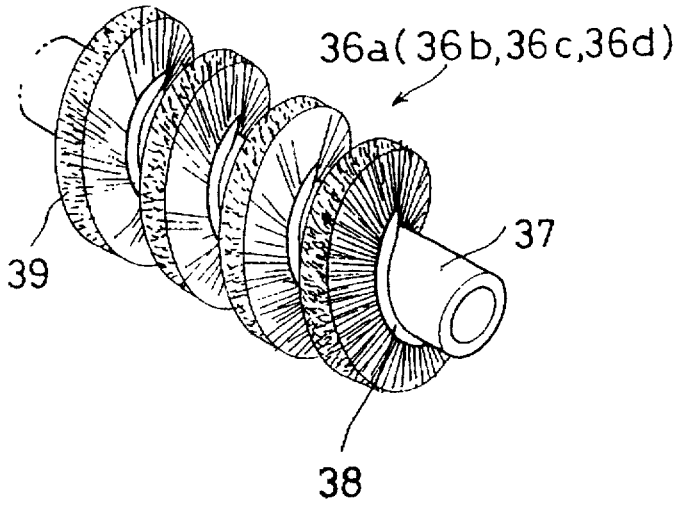
FIG. 6 is a perspective view of a rotating brush employed in the magnetic separator.
Figure 7:
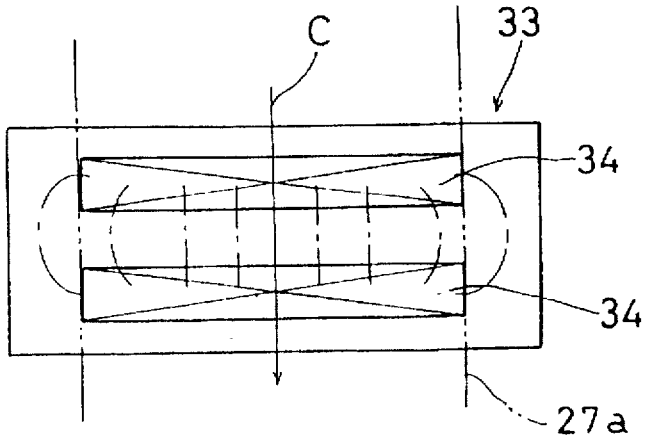
FIG. 7 is a schematic plan view of a demagnetizer constituting the magnetic separator.

A movable base 24 for holding the pickup conveying mechanism 22 is mounted on hinges 23 further mounted on the frame 13 so as to be located downstream of the feeder 15. The movable base 24 is pivotably displaceable to a raised state as shown by a two-dot chain line in FIG. 3. The pickup conveying mechanism 22 comprises a rotary drum 25 disposed on the left-hand end of the movable base 24, a guide roller 26 disposed on the right-hand end of the base, and a conveying belt 27 provided between the rotary drum 25 and the guide roller 26. The rotary drum 25 is rotated by a belt drive motor 40 in the direction opposite to the direction in which the mixture is conveyed along the feeder 15, that is, in the direction opposite to arrow b in FIG. 1. A gap is defined between the rotary drum 25 and the feeder 15. The gap is so dimensioned as to permit the mixture to pass therethrough and is adjusted by vertically moving the feeder 15 by an adjusting mechanism (not shown). The rotary drum 25 is rotatably mounted on a rotational shaft 28 extending across the movable base 24. The rotary drum 25 includes a coaxial rotating member 29 having a generally regular octagonal section as shown in FIGS. 4 and 5. The rotating member 29 has twenty-four permanent magnets 30 disposed on the outer surface thereof. The permanent magnets 30 are circumferentially arranged in three rows each of which includes eight magnets. The magnets 30 are further arranged so that three magnets of each column have the same pole and so that the outer faces of the magnets of each row alternately have the south and north poles. Consequently, a magnetic field is established circumferentially of the rotary drum 25 about the rotational shaft 28. The rotary drum 25 has a nonmagnetic outer cylinder 31 which is coaxially disposed outside the rotating member 29 to cover the magnets 30.

The conveying belt 27 is driven by rotating the rotary drum 25 by a drive mechanism (not shown). The upper side of the conveying belt 27 serves as a conveying face 27*a* (an outfeed passage) conveying the workpieces toward the guide roller 26 or in the direction of arrow c in FIG. 1. Two guide plates 32 stand along both side edges of the conveying belt 27 respectively for preventing the workpieces from falling off of the conveying face 27*a*.

A demagnetizer 33 is provided between the rotary drum 25 and the guide roller 26 so as to be located below the conveying face 27*a* of the belt 27. The demagnetizer 33 is provided with two electromagnets 34 oppositely disposed across the conveying face 27*a* or in the direction of arrow c, in which direction the separated workpieces are conveyed. See FIG. 7. Each electromagnet 34 has a width approximately equal to that of the conveying face 27*a*. Windings of the electromagnets 34 are wound in directions opposite to each other. Each electromagnet 34 is supplied with an alternating current from an electric circuit (not shown). Accordingly, the electromagnets 34 have magnetic poles opposite to each other, and the magnetic poles are periodically changed. Consequently, an alternating field is established over the conveying face 27*a* so as to extend substantially the full width thereof in the direction of conveyance.

Each of the guide plates 32 has three bearings 35 opposite to those of the other, so that three pairs of bearings are provided. Each bearing 35 has a notch with an upper opening. A rotating brush 36*a* serving as a removing member is mounted on the left-hand pair of bearings 35 as viewed in FIG. 1. The rotating brush 36*a* is positioned in the vicinity of a boundary of the rotary drum 25 where the workpieces escape from the attractive force of the rotary drum 25. The rotating brush 36*a* includes a shaft 37 insertable into the notches of the bearings 35 through the upper openings. A fixture or mounting member 38 (a magnetic substance) is wound on the shaft 37 axially spirally. A spiral bristle portion 39 including a number of nylon bristles is fastened to the outer peripheral edges of the fixture 38. The pitch of the spiral of the fixture 38 is approximately equal to the width of the workpiece when the workpiece is directed along the direction in which the workpiece is conveyed along the conveying face 27*a*. The rotating brush 36*a* is mounted on the bearings 35 so that the ends of the bristle portion 39 are brought into slight contact with the conveying face 27*a*. The rotating brush 36*a* is subjected to the magnetic force from the rotary drum 25, and upon rotation of a rotary drum 25, the rotating brush 36*a* is rotated in a direction opposite to that of the drum, that is, in the direction of conveyance of the conveying belt 27 or in the direction of arrow c.

Each of the other two rotating brushes 36*b* and 36*c* has the same construction as the above-described brush 36*a*. These rotating brushes 36*b* and 36*c* are disposed over the demagnetizer 33 with a predetermined space therebetween. Subjected to the magnetic force from the demagnetizer 33, the rotating brushes 36*b* and 36*c* are rotated in the direction of arrow c with the bristle portions 39 in slight contact with the conveying face 27*a*.

The other rotating brush 36*d* serving as a sweeping member and having the same construction as each of the above-described brushes 36*a*–36*c* rests on the feeder 15 in the vicinity of the rotating drum 25 with the shaft 37 thereof extending in the direction crossing the direction in which the mixture of the workpieces and the abrasives is conveyed along the feeder 15. Consequently, the rotating brush 36*d* is attracted to the rotary drum 25 and rotated in the direction opposite to the rotary drum 25 in contact with the conveying belt 27 upon rotation of the drum.

The operation of the magnetic separator will now be described. The mixture of the abrasives and the workpieces, after being discharged from the barrel finishing machine, is fed into the hopper 18 from above. The mixture is then caused to gradually flow through the outlet of the hopper 18 onto the feeder 15. The mixture is conveyed along the feeder 15 in the direction of arrow b in FIG. 1 with the feeder being vibrated by the vibration exciters 17. When conveyed below the rotary drum 25 through the rotating brush 36*d*, only the workpieces of the mixture are attracted to the conveying belt 27 of the rotary drum 25 by the magnetic force therefrom. The workpieces attracted to the conveying belt 27 are conveyed upwardly with the rotation of the rotary drum 25.

In the prior art, when a bar-shaped workpiece such as an elongated bolt is attracted to the conveying belt 27, the workpiece is directed in the direction crossing the direction of rotation of the rotary drum 25 as shown by arrow d in FIG. 1. When conveyed upwardly in such a condition, the workpiece slips down the conveying belt 27, remaining below the rotary drum 25. In the embodiment, however, the magnetic field is established along the direction of rotation of the rotary drum 25 or the direction of arrow d in view of the fact that the magnetic substance is apt to be attracted along the direction of the magnetic field. Consequently, since the bar-shaped workpiece is attracted in a condition in which it is directed along the direction of rotation of the rotary drum 25 or the direction of arrow d, the workpiece can be prevented from slipping down the conveying belt.

Granular abrasives sometimes adhere to the surface of the workpiece when the mixture has been discharged out of the barrel finishing machine. In such a case, with the workpiece is attracted by the rotary drum 25 with the abrasives being sandwiched by the conveying belt 27 and the workpiece, or it cannot be attracted such that the workpiece is discharged with the abrasives through the discharge passage 21. In the embodiment, however, the rotating brush 36*d* is placed on the feeder 15 so as to be rotated under the influence of the magnetic force from the rotary drum 25. Consequently, the abrasives adherent to the workpiece are brushed off by the rotating brush 36*d* when the workpiece passes below the brush.

The workpieces conveyed upwardly of the rotary drum 25 are further conveyed to the downstream side along the conveying belt 27. The workpieces then pass through the alternating field established by the demagnetizer 33, being further conveyed to the downstream side. The magnetic force from the alternating field is reduced as the workpieces are conveyed nearer to the downstream side. Thus, the workpieces magnetized by the magnetic force from the rotary drum 25 are demagnetized. The alternating field is established over the conveying face 27*a* so as to spread substantially the full width thereof in the direction of conveyance, and the magnetic flux density is uniform transversely of the conveying face 27*a*. Consequently, the workpieces can be uniformly demagnetized irrespective of the locations where the workpieces pass through the alternating field.

When the workpieces are conveyed from the upper side of the rotary drum 25 to the downstream side of the conveying belt 27, the separated workpieces are subject to the magnetic force from the rotary drum 25. When the workpieces are apt to roll due to their configuration, the workpieces are attracted to the rotary drum 25 and are not conveyed to the downstream side, being turned and remaining at the location where the conveying force of the conveying belt 27 and the magnetic force of the rotary drum 25 are in equilibrium. In the embodiment, however, the rotating brush 36*a* is provided so as to be rotated by the magnetic force from the rotary drum 25 in the same direction as the workpieces are conveyed along the conveying face 27*a* in the direction of arrow c. Consequently, since the workpieces are forced to part from the rotary drum 25, the workpieces are conveyed toward the downstream side without remaining at the boundary of the rotary drum 25. If a bar-shaped workpiece is attracted against the magnetic force from the rotary drum 25 in a condition in which the workpiece is directed so as to cross the direction of rotation of the drum and is then conveyed upwardly, the rotating brush 36*a* effectively operates since the workpiece is apt to roll. Furthermore, when the workpiece is substantially spherical, the rotating brush 36*a* is particularly effective, because the drum's attraction of the workpiece to direct it so as to cross the direction of rotation thereof is voidable.

The workpieces are also subject to the magnetic force from the demagnetizer 33 when passing over the demagnetizer 33. When the workpieces are apt to roll, they remain at the location where the conveying force of the conveying belt 27 and the magnetic force of the demagnetizer 33 are in equilibrium. In the embodiment, however, the two rotating brushes 36*b* and 36*c* provided over the conveying face 27*a* operate to push the workpieces toward the downstream side. Accordingly, the rotating brushes are effective for the conveyance of the separated workpieces. Furthermore, since the workpieces are prevented from remaining over the demagnetizer 33, the demagnetizing efficiency can be improved.

The pitch of the spiral of the bristle portion 39 composing each of the brushes 36*a*, 36*b* and 36*c* provided over the conveying face 27*a* is approximately equal to the width of the workpiece when the workpiece is directed in the direction in which the workpiece is conveyed along the conveying face 27*a*. Accordingly, when the workpiece is pushed out by each of the rotating brushes, the attitude of the workpiece is corrected so that the workpiece is directed in the direction of conveyance thereof or in the direction of arrow c. Since the workpiece is not easy to roll in the corrected attitude, the rotating brushes 36*a*, 36*b* and 36*c* are further effective for preventing the workpieces from remaining on the upper conveying face 27*a*. Furthermore, it is empirically understood that the workpiece can be more efficiently demagnetized when passing through the alternating field in a condition in which the workpiece is directed along the alternating field. Consequently, the residual magnetism can be further reduced.

According to the first embodiment, the workpieces only can be reliably attracted to the rotary drum 25 as the result of the provision of the rotating brush 36*d* over the feeder 15. Furthermore, the magnetic field from the rotary drum 25 is established along the direction of rotation thereof or in the direction of arrow d in FIG. 1, and the three rotating brushes 36*a*, 36*b* and 36*c* are provided over the conveying face 27*a*. Consequently, the workpieces can be prevented from remaining on the feeder 15 and the conveying face 27*a*, whereupon the separating efficiency can be improved. Furthermore, each rotating brush includes the spiral bristle portion 39. Even small workpieces are brought into contact with a groove edge of the bristle portion 39 during one turn of the rotary drum 25. The spiral pitch of the bristle portion 39 can reliably feed the workpieces toward the downstream side. The spirally disposed bristle portion 39 can reduce the manufacturing cost as compared with the case where the bristle portion 39 is disposed over the entire outer surface of the shaft 37, and a high workpiece feeding efficiency can be ensured. Furthermore, since the magnetized workpieces are demagnetized uniformly and efficiently, unevenness in the demagnetization can be prevented, and accordingly the residual magnetism can be reduced. Furthermore, the rotating brush 36*d* is subject to the magnetic force from the rotary drum 25 and the rotating brushes 36*a*–36*c* are subject to the magnetic force from the demagnetizer 33 so that the brushes are rotated. Consequently, since no separate power source is required for the rotating brushes, the construction of the separator can be simplified and energy savings can be provided. Additionally, since the pickup conveying mechanism 22 is connected via the hinges 23 to the frame 13, the pickup conveying mechanism 22 can be caused to be raised for the purpose of repair or adjustment as shown by the two-dot chain line in FIG. 3. Consequently, repair and adjusting work can be easily carried out.

Figure 8:
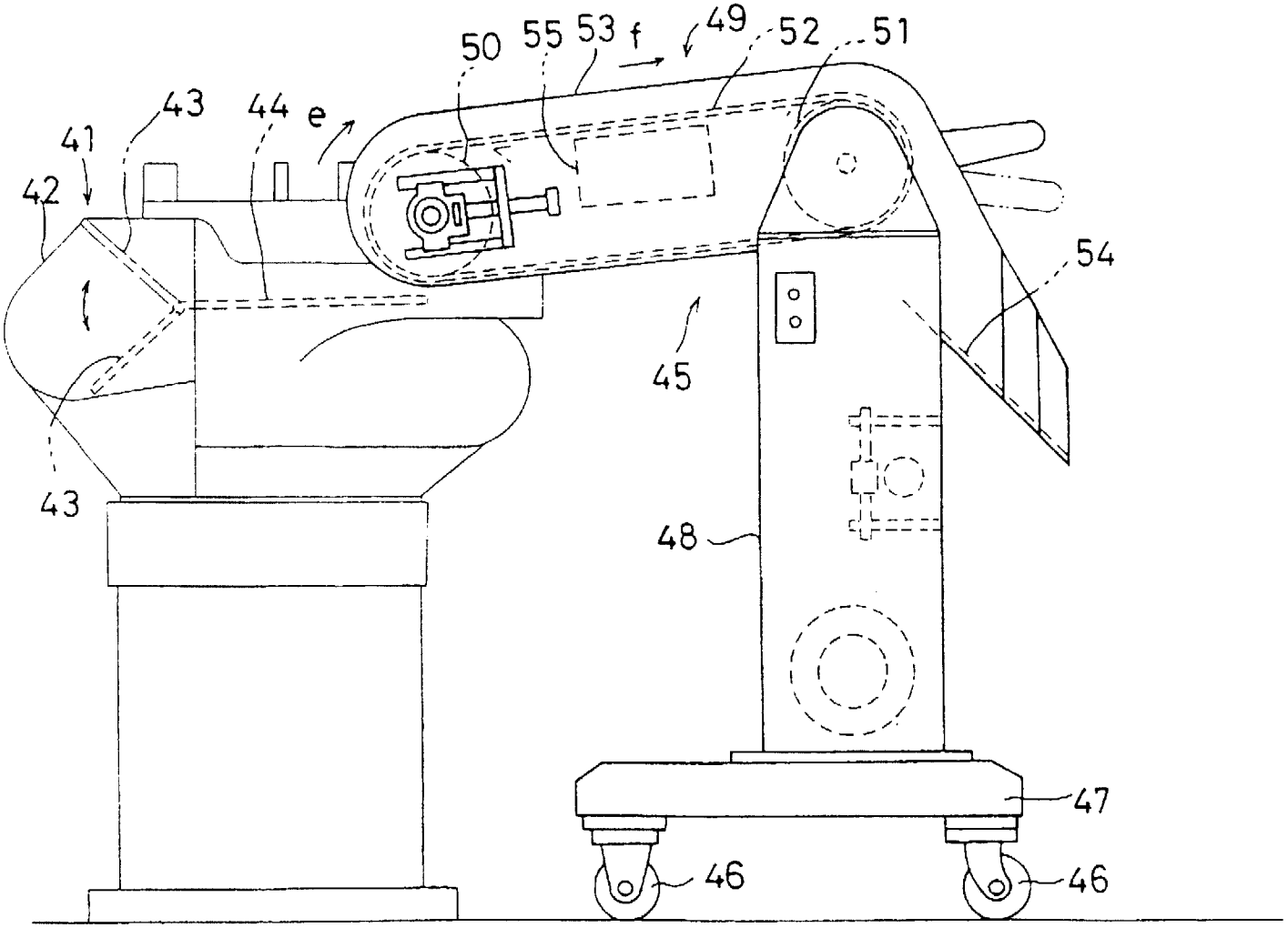
FIG. 8 is a front view of a magnetic separator of a second embodiment in accordance with the present invention.
Figure 9:
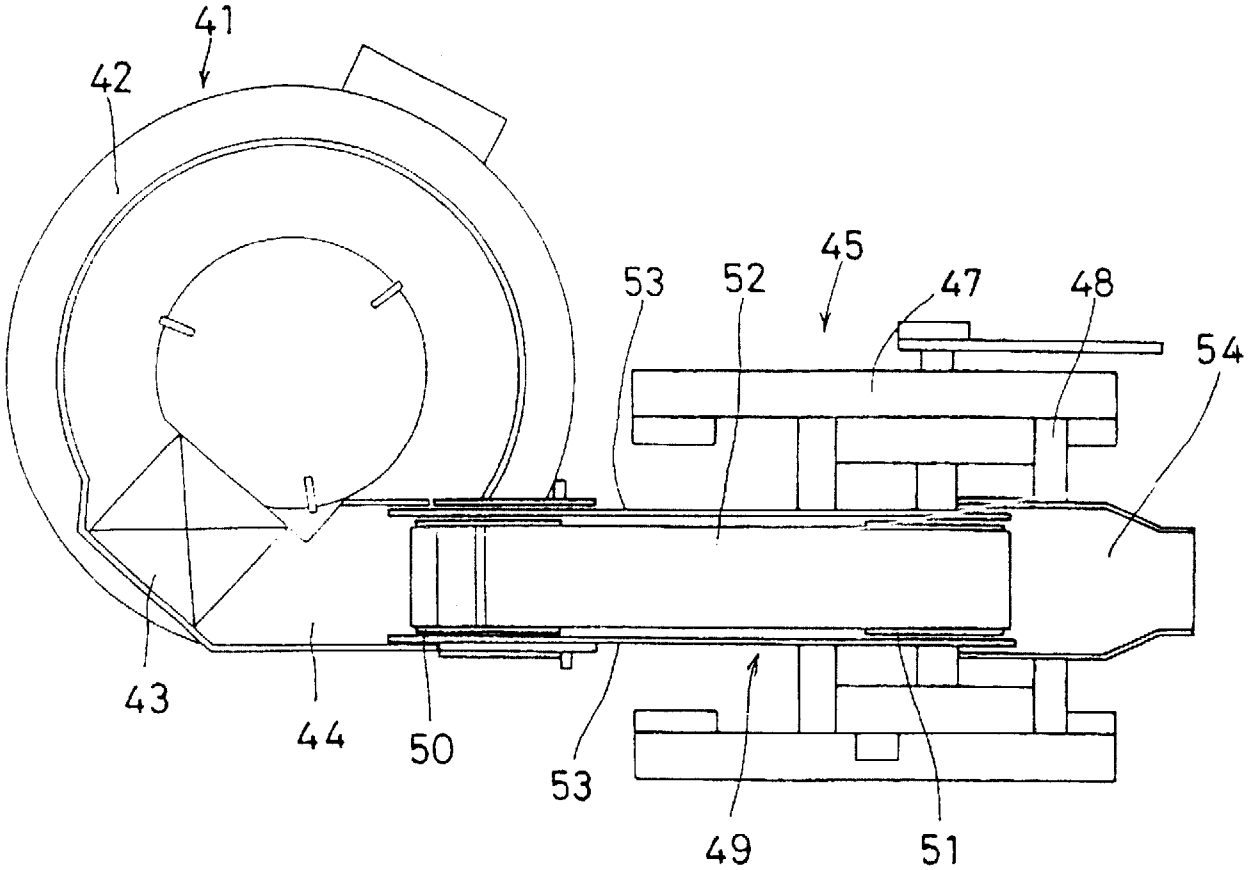
FIG. 9 is a top view of the magnetic separator.

FIGS. 8 and 9 illustrate a second embodiment of the present invention. The magnetic separator of the first embodiment is provided with the vibratory conveyor 11 so that the mixture of the workpieces and the abrasives discharged out of the barrel finishing machine is fed onto the feeder 15 by means of vibration. In the second embodiment, no vibratory conveyor is provided and instead, the magnetic separator is directly linked to an outlet of the barrel finishing machine.

First, the barrel finishing machine will be briefly described. Referring to FIGS. 8 and 9, a circular barrel finishing machine 41 is shown which comprises an annular recirculating tub 42 and a flap 43. The workpieces and the abrasives are recirculated in the recirculating tub 42 so that the workpieces are finished. The flap 43 is pivotally mounted on one end of the tub 42 so as to be opened and closed. The mixture of the workpieces and the abrasives is fed to the outlet when the flap 43 is closed (lowered). The mixture is fed along a connecting passage 44 to an outlet provided at the termination of the passage. The magnetic separator 45 of the second embodiment is located in front of the outlet so as to be linked thereto.

A magnetic separator 45 comprises a carriage 47 with wheels 46 and a frame 48 carried on the carriage 47. A pickup conveying mechanism 49 is rotatably mounted on one end of the frame 48. The pickup conveying mechanism 49 comprises a rotary drum 50, a guide roller 51 provided at one end of the frame 48, and a conveying belt 52 attached between the drum 50 and the guide roller 51, as in the first embodiment. A magnetic field is established along the direction of rotation of the rotary drum 50 or in the direction of arrow e in FIG. 8. The magnetic separator 45 is linked at the rotary drum 50 to the termination of the connecting passage 44 of the barrel finishing machine 41 with a predetermined space therebetween. The space is determined so that the mixture of the workpieces and the abrasives is allowed to pass therethrough. The space can be adjusted by rotatively moving the pickup conveying mechanism 49 around the end of the frame 48.

Two guide plates 53 are provided along respective side edges of the conveying belt 52 for preventing the separated workpieces from falling off of the belt during conveyance. The guide plates 53 protrude slightly over the conveying belt 52. A feed plate 54 is provided at the downstream end of the conveying belt 52 so as to extend obliquely downward. The guide plates 53 extend to the left-hand end of the feed plate 54 as viewed in FIG. 9. A demagnetizer 55 is provided below the upper side of the conveying belt 52. As the result of excitation of the demagnetizer 55, an alternating field is established in the direction of conveyance of the workpieces or in the direction of arrow f in FIG. 8 as in the foregoing embodiment.

In the operation of the magnetic separator 45, the workpieces and the abrasives recirculated in the tub 42 are guided to the connecting passage 44 over the flap 43 when the flap is closed as shown by dotted line in FIG. 8. The mixture then passes through the connecting passage 44, and subsequently only the workpieces are attracted to the rotary drum 50 at the termination of the passage to be thereby conveyed on the conveying belt 52. The remainder is returned to the recirculating tub 42. Since the magnetic field from the rotary drum 50 is established along the direction of rotation thereof or in the direction of arrow e in FIG. 8, the workpieces, even when they are bar-shaped, are attracted to the conveying belt 52 in a condition in which they are directed along the direction of rotation of the rotary drum 50 or in the direction of arrow e. Consequently, the workpieces can be prevented from slipping down the conveying belt 52 and remaining below the same. Furthermore, having been conveyed upwardly, the attracted workpieces are further conveyed to the downstream side of the pickup conveying mechanism 49. The workpieces then pass through the alternating field established by the demagnetizer 55 onto the feed plate 54. Since the alternating field is established in the direction of conveyance of the workpieces or in the direction of arrow f in FIG. 8, the magnetized workpieces can be uniformly demagnetized as in the first embodiment.

The rotating brushes 36*a*, 36*b*, and 36*c* may be provided on the conveying belt 52 over the rotary drum 50 and the demagnetizer 55 as in the first embodiment, though the arrangement of the brushes is not shown in FIGS. 8 and 9. Consequently, the workpieces can be prevented from remaining due to the magnetic force from each of the rotary drum 50 and the demagnetizer 55.

The same effect can be achieved in the second embodiment as in the first embodiment, that is, the separating efficiency can be improved and the residual magnetism can be reduced. Furthermore, since the vibratory conveyor 11 is eliminated in the second embodiment, the construction of the magnetic separator can be further simplified.

The present invention should not be limited to the foregoing embodiments. The invention can be practiced in the following modified forms. First, in the foregoing embodiment, the rotating brush 36*a* is subject to the magnetic force from the rotary drum and the rotating brushes 36*b*–36*c* are subject to the magnetic force from the demagnetizer so that the brushes are rotated. Separate drive means may be provided for rotating the brushes instead, however.

Second, the permanent magnets 30 provided in the rotary drum 25 are disposed so that the magnets having the same pole are axially arranged and so that the magnets having the north and south poles are alternately arranged circumferentially of the drum. Electromagnets may be provided instead of the permanent magnets. Alternatively, a magnetized outer cylinder may be employed for the rotary drum. Thus, any member or any construction may be employed provided that the magnetic field is established circumferentially of the rotary drum.

Figure 10:
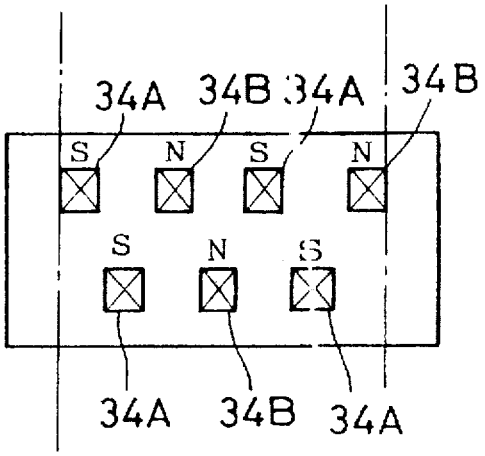
FIG. 10 is a schematic plan view of a demagnetizer employed in a modified form of the invention, showing an arrangement of electromagnets.
Figure 11:
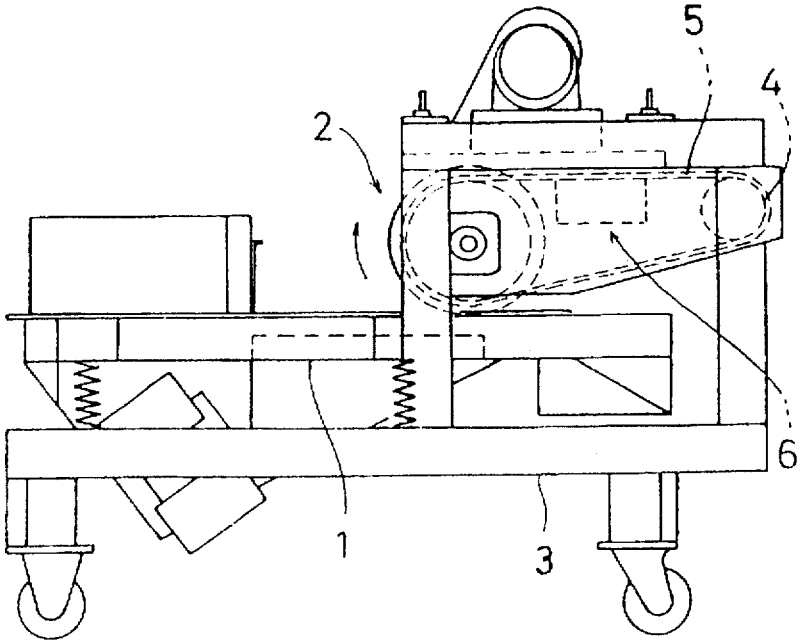
FIG. 11 is a front view of a conventional magnetic separator.
Figure 12:
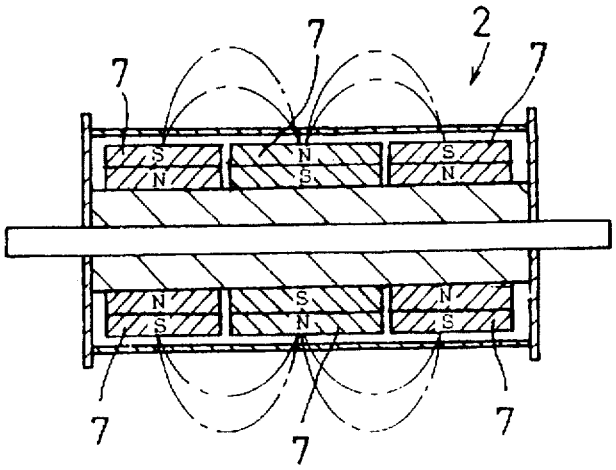
PRIOR ART Fig·12
FIG. 12 is a sectional view of a rotary drum of the conventional magnetic separator.
Figure 13:
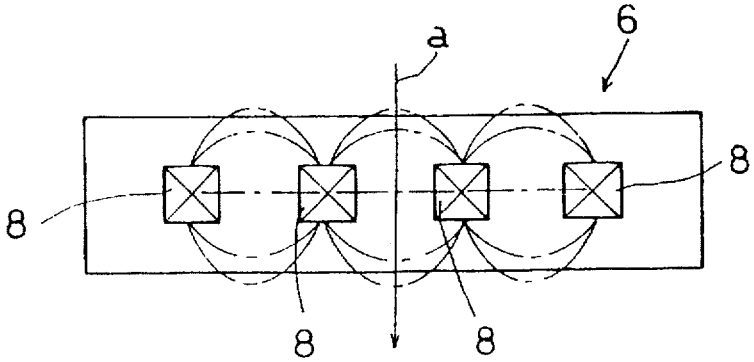
FIG. 13 is a schematic plan view of a demagnetizer of the conventional magnetic separator.

Third, each of the demagnetizers 33 and 55 in the respective foregoing embodiments is provided with two oppositely disposed electromagnets 34. Instead, a plurality of electromagnets 34A and 34B may be arranged in a two rows in zigzag arrangement or in a stagger arrangement as shown in FIG. 10, so that the demagnetizing effect can be improved. In the modified form shown in FIG. 10, two rows of electromagnets are disposed so as to cross the direction in which the workpieces are conveyed. In each row, the magnet of the north pole and the magnet of the south pole are alternately arranged. Furthermore, the electromagnets of the second row are positioned between the electromagnets of the first row as shown in FIG. 10. In this arrangement, the demagnetization by the first row of electromagnets, if insufficient, can be compensated by the second row of electromagnets.

Fourth, the metal workpieces serve as the magnetic substance and the abrasives serve as the nonmagnetic substance in the foregoing embodiments. Instead, workpieces may serve as the nonmagnetic substance and the abrasives may serve as the magnetic substance. Thus, the present invention is applied to the mixture of the magnetic and non magnetic substances.

Fifth, although the spiral bristle portion 39 is axially fastened to the fixture 38 in the foregoing embodiments, the bristles may be provided on the entire circumferential surface of the shaft, instead. Furthermore, an elastic member such as rubber or sponge may be used instead of the bristle portion 39.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. A magnetic separator, comprising:

an infeed passage for conveying a mixture of a magnetic substance and a nonmagnetic substance;

a rotary drum that is rotatable about an axis that crosses said infeed passage, said rotary drum having a circumferential surface; and a magnet arrangement in said rotary drum capable of attracting the magnetic substance from said infeed passage to said circumferential surface;

wherein said magnet arrangement defines a magnetic field that extends circumferentially of said rotary drum such that the attitude of the magnetic substance, when conveyed along the infeed passage and attracted to said circumferential surface of said rotary drum, is corrected to be directed circumferentially of said rotary drum.

2. The magnetic separator of claim 1, wherein said magnet arrangement comprises two sets of magnets arranged circumferentially of said rotary drum as seen in a section taken perpendicular to the axis of said rotary drum, one of said sets of magnets including a plurality of magnets that each has a north pole facing radially outward and the other of said sets including a plurality of magnets disposed between said plurality of magnets of the one of said sets and each having a south pole facing radially outward.

3. The magnetic separator of claim 2, and further comprising a sweeping member along said infeed passage adjacent to said rotary drum and positioned so as to be capable of scraping the surface of the magnetic substance, thereby sweeping off extraneous matter that adheres to the surface of the magnetic substance.

4. The magnetic separator of claim 2, and further comprising a sweeping member along said infeed passage adjacent to said rotary drum and positioned so as to be capable of scraping the surface of the magnetic substance, said sweeping member comprising a magnetized shaft that extends parallel with the axis of said rotary drum and that is mounted so as to be freely rotatable and rotated by rotation of said rotary drum and a bristle portion projecting radially from said shaft for sweeping off extraneous matter that adheres to the surface of the magnetic substance.

5. The magnetic separator of claim 4, wherein said bristle portion forms a spiral along the axis of said free rotating shaft.

6. The magnetic separator of claim 1, and further comprising a sweeping member along said infeed passage adjacent to said rotary drum and positioned so as to be capable of scraping the surface of the magnetic substance, thereby sweeping off extraneous matter that adheres to the surface of the magnetic substance.

7. The magnetic separator of claim 1, and further comprising a sweeping member along said infeed passage adjacent to said rotary drum and positioned so as to be capable of scraping the surface of the magnetic substance, said sweeping member comprising a magnetized shaft that extends parallel with the axis of said rotary drum and that is mounted so as to be freely rotatable and rotated by rotation of said rotary drum and a bristle portion projecting radially from said shaft for sweeping off extraneous matter that adheres to the surface of the magnetic substance.

8. The magnetic separator of claim 7, wherein said bristle portion forms a spiral along the axis of said free rotating shaft.

9. A magnetic separator comprising:

an infeed passage for conveying a mixture of a magnetic substance and a nonmagnetic substance;

a rotary drum that is rotatable about an axis that crosses said infeed passage, said rotary drum having a circumferential surface;

a magnet arrangement in said rotary drum capable of attracting the magnetic substance from said infeed passage to said circumferential surface;

an outfeed passage extending from said rotary drum such that when the magnetic substance is conveyed along said infeed passage and attracted to said rotary drum the magnetic substance is conveyed from said rotary drum by said outfeed passage; and a removing member disposed along said outfeed passage for scraping the magnetic substance to remove the magnetic substance from said rotary drum.

10. The magnetic separator of claim 9, wherein said removing member comprises a rotatable mounting shaft adjacent to said rotary drum and positioned over said outfeed passage parallel with the axis of said rotary drum and a bristle portion that extends spirally along the axis of said mounting shaft, said bristle portion having a spiral edge for removing the magnetic substance from said rotary drum.

11. A magnetic separator comprising:

an infeed passage for conveying a mixture of a magnetic substance and a nonmagnetic substance;

a rotary drum that is rotatable about an axis that crosses said infeed passage, said rotary drum having a circumferential surface;

a magnet arrangement in said rotary drum capable of attracting the magnetic substance from said infeed passage to said circumferential surface;

an outfeed passage extending from said rotary drum such that when the magnetic substance is conveyed along said infeed passage and attracted to said rotary drum the magnetic substance is conveyed from said rotary drum by said outfeed passage; and a demagnetizer positioned along said outfeed passage that is capable of establishing an alternating magnetic field along a direction in which the magnetic substance is conveyed along said outfeed passage when the magnetic substance is conveyed along said outfeed passage.

12. A magnetic separator comprising:

an infeed passage for conveying a mixture of a magnetic substance and a nonmagnetic substance;

a rotary drum that is rotatable about an axis that crosses said infeed passage, said rotary drum having a circumferential surface;

a magnet arrangement in said rotary drum capable of attracting the magnetic substance from said infeed passage to said circumferential surface;

an outfeed passage extending from said rotary drum such that when the magnetic substance is conveyed along said infeed passage and attracted to said rotary drum the magnetic substance is conveyed from said rotary drum by said outfeed passage; and a plurality of magnets disposed in a zigzag arrangement along said outfeed passage for establishing an alternating magnetic field that crosses a direction in which the magnetic substance is conveyed along said outfeed passage when the magnetic substance is conveyed along said outfeed passage.

* * * * *